United States Patent [19]

Juillard et al.

[11] 4,057,083

[45] Nov. 8, 1977

[54] DOUBLE-LAYER WEAVING LOOM

[75] Inventors: Yves Juillard; Victor Riner, both of Mulhouse, France

[73] Assignee: Societe Alsacienne de Constructions Mecaniques de Mulhouse, Mulhouse Cedex, France

[21] Appl. No.: 719,333

[22] Filed: Aug. 31, 1976

[30] Foreign Application Priority Data

Sept. 5, 1975 France ..... 75.27246

[51] Int. Cl.[2] ..... D03D 41/00

[52] U.S. Cl. ..... 139/20

[58] Field of Search ..... 139/20, 21, 22, 23, 139/55, 188 R

[56] References Cited

U.S. PATENT DOCUMENTS

| | | | |
|---|---|---|---|
| 639,626 | 12/1899 | Steere | 139/22 |
| 1,009,041 | 11/1911 | Bosset et al. | 139/20 |
| 1,042,339 | 10/1912 | Gratreau | 139/20 |
| 3,960,185 | 6/1976 | Buhler | 139/22 |

*Primary Examiner*—Henry S. Jaudon
*Attorney, Agent, or Firm*—Holman & Stern

[57] ABSTRACT

In a shuttleless weaving loom of the double layer type, the position of the heald eyes and the relative displacement of the harness shafts which carry the eyes are such that, in the bottom position of the lower layers, the center-lines of the segments of the two layers, which are located between the rearmost position of the weaving loom and its intermediate position corresponding to the beginning of introduction of the weft threads into the sheds, both pass substantially through the pivotal axis of the reed.

5 Claims, 3 Drawing Figures

DOUBLE-LAYER WEAVING LOOM

FIELD OF THE INVENTION

This invention relates to shuttleless weaving looms of the double layer type in which weft inserters, and especially weft-inserting needles located at two different levels, introduce the weft threads into the two superposed sheds and withdraw them from these latter.

BACKGROUND OF THE INVENTION

In looms of this type, the invention is more particularly directed to the so-called "flying needle" looms in which the needles are guided within the shed solely by bearing within the dihedral angle constituted by the plane of the reed and the plane of the lower layer of warp threads.

Looms of the double layer type are employed either for doubling the output for the same rate of weft insertion or for forming two layers of velvet or plush fabric.

It has become apparent that, in the case of a double-layer loom employed for the purpose of doubling the output, the same rate of insertion as in a single-layer loom could not readily be attained since the trajectories of the needles located at two different levels were not absolutely identical and gave rise to difficulties in regard to the exchange of wefts between the entry needles and the exit needles.

In double-layer looms, it is already a known practice to choose the position of the heald eyes so as to ensure that the lower layers of the two sheds on which the needles rest are always substantially parallel to each other. In spite of this favorable geometrical arrangement, however, the needles are liable to be subjected to stresses which cause them to deviate from their ideal trajectories within the aforesaid dihedral angle during their displacement with the slay of the loom and especially when the reed is inclined.

SUMMARY OF THE INVENTION

The aim of the present invenion is to overcome this disadvantage and to permit the construction of a double-layer loom in which the two superposed needles of one pair of needles always remain naturally parallel to each other and at a constant distance from one another.

The invention is directed to a loom in which, in the bottom position of the lower layers, the center-lines of the segments of said two layers located between the rear end position, of the reed of the loom and its intermediate position corresponding to the beginning of introduction of the needles into the shed, both pass substantially through the pivotal axis of the slay of the loom.

A more complete understanding of the invention will be gained from the following detailed description and from the accompanying drawings in which a number of embodiments of the invention are shown by way of example but not in any limiting sense, and in which:

DESCRIPTION OF PREFERRED EMBODIMENTS

Figures 1, 3:
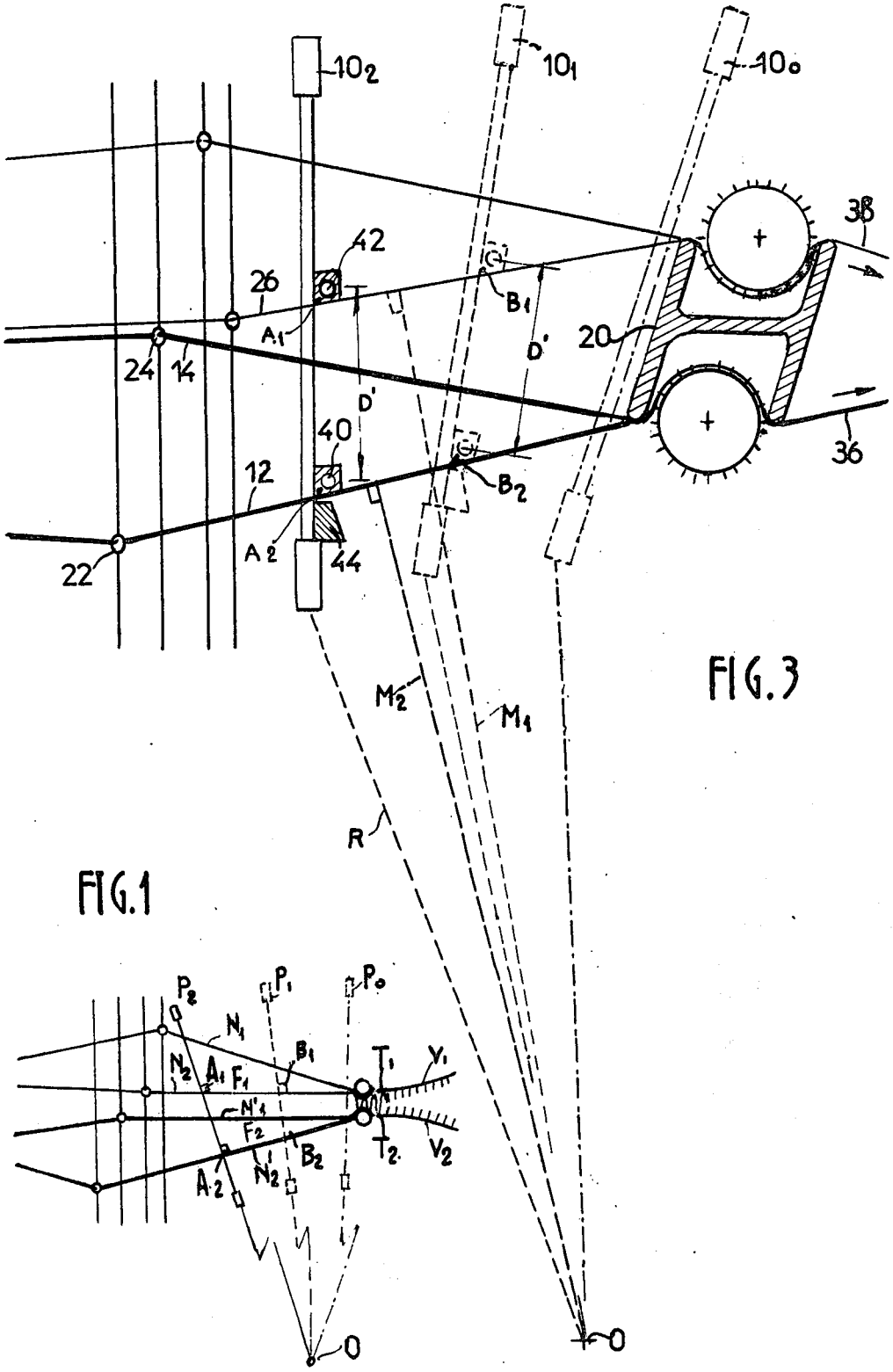
FIG. 1 is a diagrammatic view showing the arrangement of the layers of warp threads in a conventional double-layer loom for velvet.
FIG. 3 shows an alternative form of FIG. 2 in the case of a loom having an inclined reed.

In the diagram of FIG. 1, the reed is shown in a conventional velvet loom in the beating-up position Po, in the intermediate position P1, and in the rear position P2. The upper shed F1 is formed by the upper layer N1 and by the lower layer N2 whilst the lower shed F2 is formed by the upper layer N'1 and by the lower layer N'2. The lower layer N2 and the upper layer N'1 are substantially parallel and the yarn (not shown) which is intended to form the velvet pile is interposed between these two layers in order to form two woven fabrics T1–T2 which are joined together by the pile threads, these latter being subsequently cut so as to form two separate velvet layers V1–V2.

There is shown at A1–A2 and B1–B2 the position of the upper and lower needles in the two positions P2–P1 of the reed. It is clearly apparent that the relative distance of a lower needle and of an upper needle will not be constant and on the other hand that the distance from the needles to the point of articulation 0 of the reed will not be constant. In the case of a loom in which guide means are not provided within the shed, this will subject the needles to stresses which have an adverse effect on the correct exchange of the weft thread between the entry needle and the exit needle.

Figure 2:
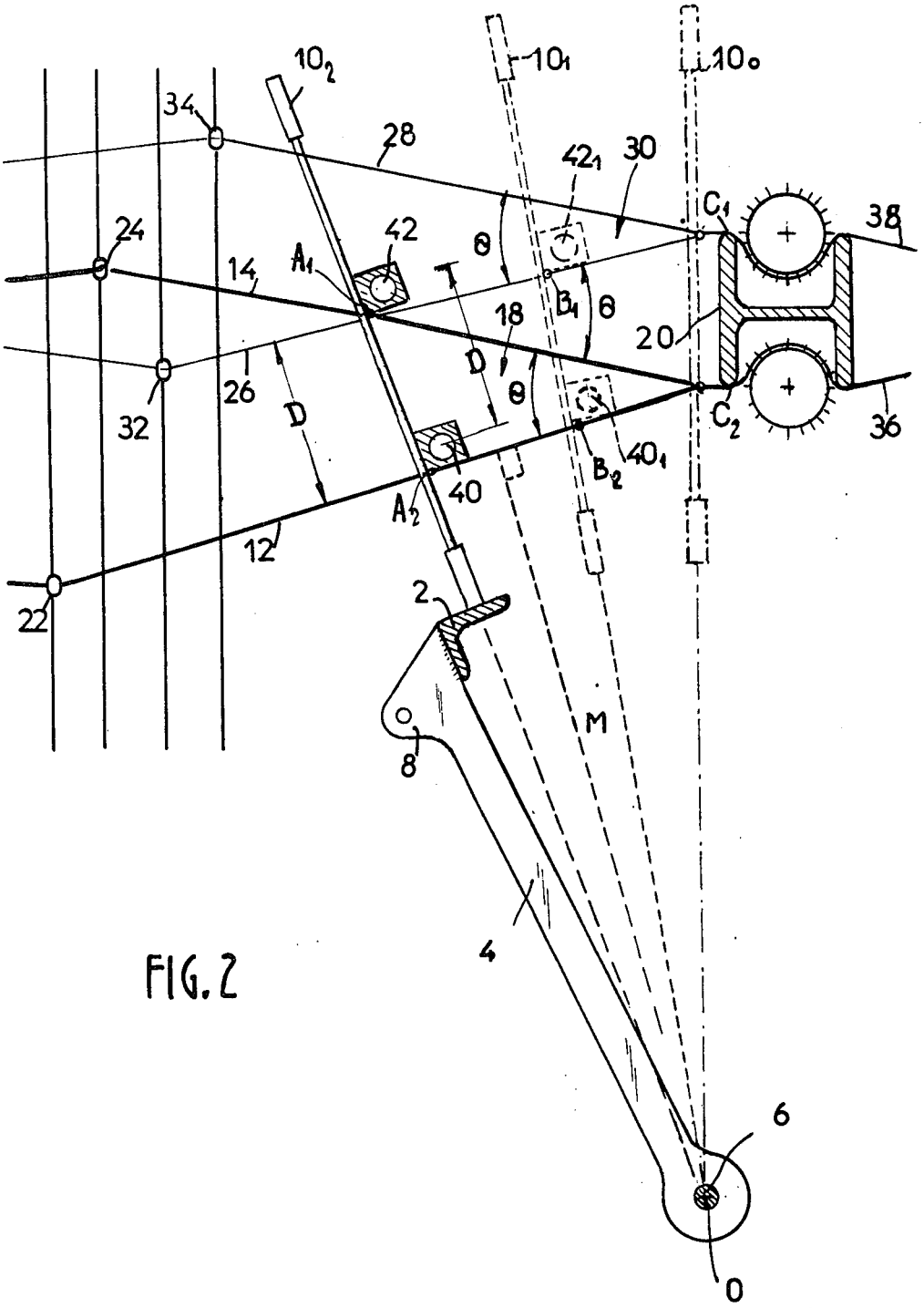
FIG. 2 is a part-sectional view of a double-layer loom which embodies the improvement in accordance with the invention.

In the double-shed weaving loom in accordance with the invention which is shown only in part in FIG. 2, there is shown the upper portion 2 of the slay which is mounted on swords 4. Said swords are pivoted about a shaft 6 having a center 0, said shaft 6 being supported by the frame of the loom. The movement of oscillation of the slay is controlled by a crankshaft (not shown) which actuates lugs 8.

By means of a slay cap (not shown), the slay 2 supports a reed 10 so designed as to have a height which is sufficient to receive two superposed sheds.

The lower layer 12 and the upper layer 14 of the lower shed 18 are positioned by the bottom edge C2 of the breast beam 20 and by heald eyes such as those designated by the references 22–24 and controlled by the harnesses which are not shown in the drawings and are employed for forming the shed.

The lower layer 26 and the upper layer 28 of the upper shed 30 are positioned by the top edge C1 of the breast beam 20 and by heald eyes 32–34.

The two pieces of fabric produced by the loom are indicated at 36 and 38 and the needle of the lower shed and the needle of the upper shed are designated respectively by the references 40 and 42.

The reed 10 in the beating-up position is shown in chain-dotted lines and designated by the reference $\mathbf{10_0}$. In the intermediate starting position of the needles, the reed is indicated at $\mathbf{10_1}$ whilst the reed is shown in full lines and designated by the reference $\mathbf{10_2}$ at the rear dead point. In the intermediate position $\mathbf{10_1}$ of the reed, the needles are shown in chain-dotted lines and designated by the references $\mathbf{40_1}$ and $\mathbf{42_1}$. The vertex of the dihedral angles formed by the plane of the read in its positions $\mathbf{10_2}$–$\mathbf{10_1}$ and by the planes of the layers 12 and 26 (the guiding of the needles being ensured by means of said dihedral angles) is indicated by the points $A_1$–$A_2$ and $B_1$–$B_2$.

The position of the heald eyes 22–24–32–34 and the relative displacement of the harnesses which support the healds are chosen so as to ensure that the angle $\theta$ of maximum opening of the sheds is sufficient for the introduction and withdrawal of the needles and of the wefts.

In accordance with the embodiment illustrated in FIG. 2, the position of the eyes is also chosen so as to ensure that the lower layer 26 of the upper shed and the upper layer 14 of the lower shed interpenetrate. The intersection of these two layers must take place along a line which is always located behind the reed in its rear position $10_2$ or in an extreme case as illustrated in FIG. 2, in the plane of the reed or in other words substantially at the point $A_1$ in FIG. 2 so as to ensure that the upper layer 14 of the lower shed does not interfere with the trajectory of the upper needle 42.

When the reed oscillates between the positions $10_1$–$10_2$–$10_1$, the lower needle 40 slides over the segment $A_2$–$B_2$ of the lower layer 12 whilst the upper needle 42 slides over the segment $A_1$–$B_1$ of the upper layer 26.

In accordance with the invention, the location and relative displacement of the eyes 22-24-32-34 are chosen so as to ensure that the center-lines M normal to the two segments $A_1$–$B_1$ and $A_2$–$B_2$ pass substantially through the center 0 of articulation of the reed.

By virtue of this arrangement, the relative distance D of the needles remains constant throughout the trajectory of this latter and the same applies to the respective distance between the needles and the center 0 of articulation of the reed. In consequence, the wholly rectilinear trajectory of the two parallel needles can be maintained throughout the travel of these latter through the sheds and this permits correct exchange of the weft thread even at high insertion rates.

In the case illustrated in FIG. 2, the plane of the reed 10 passes through the pivotal axis 0 or, in other words, the reed is "straight" on the sley and not inclined. In this particular case, the segments $A_2$–$B_2$ and $A_1$–$B_1$ are parallel and the center-lines M of these latter coincide. In other words, the lower layers 12 and 26 of the two sheds are parallel and located at a distance D from each other which is equal to the constant spacing of the two needles 40–42.

In practice, it is often advantageous to ensure that the reed is "inclined" for the operation of the loom.

A case of this type is illustrated in FIG. 3 in which the same reference numerals as in FIG. 2 have been adopted. It is apparent that the plane of the reed 10 does not pass through the articulation 0 since the reed is inclined in the forward direction.

In accordance with the invention, the center-line $M_1$ normal to the segment $A_1$–$B_1$ of the layer 26 and the center-line $M_2$ normal to the segment $A_2$–$B_2$ of the layer 12 are concurrent in the center of articulation 0 of the slay but these two centerlines do not coincide as in the case of FIG. 2 by reason of the inclination of the reed with respect to the radius R.

Since these two center-lines do not coincide, the segments $A_1$–$B_1$ and $A_2$–$B_2$ are not parallel. In other words, the lower layers 12 and 26 are also not exactly parallel, in contrast to the particular case of FIG. 2. It is also seen in FIG. 3 that interpenetration of the layers is not essential.

In accordance with the invention and as in the case of FIG. 2, the distance D' between the lower and upper needles 40–42 remains constant and the same applies to the distance between each needle and the center articulation 0.

In accordance with usual practice, the reed can comprise a bottom needle board 44, this board being intended to travel over the segment $A_2$–$B_2$ or more precisely the circular arc $A_2$–$B_2$ while being applied with slight friction against the layer. It can therefore be stated that said needle board defines the geometrical construction which is favorable to good guiding of the needles even if the heald eyes 22–24 do not exactly define this construction.

Similarly, in the case of the layer 26 of the upper shed, provision can be made (as described in French patent Application No. 75 18199 filed on June 11, 1975 in the name of the present Applicant) for an ancillary board placed immediately behind the reed and constituted, for example, by a wire or rod stretched transversely with respect to the layer.

It may clearly be difficult in practice to determine on the layers of threads which have a certain mobility and certain elasticity, whether the center-line of a segment passes substantially through a pivotal axis. For this reason it is easier to ascertain both with a straight reed and with an inclined reed whether, in positions $10_1$ and $10_2$ of the reed, the points $A_2$ and $B_2$ of passage of the layers through the reed are in fact located at the same height on the reed and whether the same applies to the points $A_1$ and $B_1$. To this end, it is possible, for example, to stretch two threads over the reed and to check whether they are in fact in contact respectively with the layers 12 and 26 at the points $A_2$–$B_2$ and $A_1$–$B_1$.

As can readily be understood, the invention is not limited to the embodiments described and illustrated and, depending on the applications which may be contemplated, can extend to a large number of alternative forms which are within the capacity of those versed in the art without thereby departing either from the scope or the spirit of the invention.

We claim:

1. A multiple shuttleless loom comprising: a breast beam, double shed forming means having healds with warp thread guiding eyes vertically, alternately-movable between lowermost and uppermost positions to form two sheds, each with a lower layer and an upper layer, a sley pivotally mounted for rocking movement on a transverse horizontal axis, a reed secured to said sley for corresponding rocking movement together therewith between an extreme rear position and an extreme fore position through an intermediate position, reciprocating weft thread inserting needles supported by said sley for inserting weft thread into said sheds, said needles beginning entry into the sheds upon said reed passing through said intermediate position during the rearward movement thereof, said lower layers having segments located between said extreme rear position and said intermediate position of said reed, said loom being characterized in that said lowermost positions of said heald eyes are so located with respect to said breast beam that center-lines normal to said segments of said lower layers pass substantailly through said pivotal axis of said sley.

2. A loom according to claim 1, wherein said weft inserting needles pass through said sheds without guide means.

3. A loom according to claim 2, wherein, in said rear and intermediate positions of the reed, the lower layers of each shed are located respectively and substantially at the same height on the reed.

4. A loom according to claim 1 wherein, in the bottom position of the lower layers, the lower layers of the upper shed and of the lower shed are substantially parallel.

5. A loom according to claim 1 wherein, in the bottom position of the lower layers, the lower layer of the upper shed interpenetrates the upper layer of the lower shed and wherein the line of intersection of said layers is located behind the plane of the reed and in an extreme case in the plane of the reed.

* * * * *